US005735972A

United States Patent [19]

Kishikawa et al.

[11] Patent Number: 5,735,972

[45] Date of Patent: Apr. 7, 1998

[54] BLACK CHROMATE-TREATMENT SOLUTION FOR ZN-NI ALLOY PLATED FILM

[75] Inventors: Seiji Kishikawa; Takashi Yamamoto, both of Tokyo, Japan

[73] Assignee: Dipsol Chemicals Co., Ltd., Tokyo, Japan

[21] Appl. No.: 671,596

[22] Filed: Jun. 28, 1996

[30] Foreign Application Priority Data

May 23, 1996 [JP] Japan ..... 8-127971

[51] Int. Cl.[6] ..... C23C 22/26

[52] U.S. Cl. ..... 148/266; 148/267; 148/268

[58] Field of Search ..... 148/266, 268

[56] References Cited

U.S. PATENT DOCUMENTS

| | | | |
|---|---|---|---|
| 2,393,664 | 1/1946 | Thomas | 148/266 |
| 3,855,010 | 12/1974 | Shermaitis | 148/266 |
| 4,776,898 | 10/1988 | Verberne | 148/266 |
| 5,415,702 | 5/1995 | Bishop et al. . | |

FOREIGN PATENT DOCUMENTS

| | | |
|---|---|---|
| 1-168875 | 7/1989 | Japan . |
| 4-56782 | 2/1992 | Japan . |
| 4-232279 | 8/1992 | Japan . |
| 4-232280 | 8/1992 | Japan . |
| 7-30456 | 4/1995 | Japan . |
| 7-166367 | 6/1995 | Japan . |

*Primary Examiner*—Sam Silverberg

*Attorney, Agent, or Firm*—Oblon, Spivak, McClelland, Maier & Neustadt, P.C.

[57] ABSTRACT

A black chromate-treatment solution for Zn-Ni alloy plated film comprises 1 to 100 g/l of hexavalent chromium, 1 to 100 g/l of hydrochloric acid residues and/or sulfuric acid residues, 1 to 100 g/l of nitric acid residues and 1 to 100 g/l of at least one metal selected from the group consisting of iron, nickel, cobalt and copper. The chromate-treatment solution permits the formation of a uniform black chromate conversion film on a Zn-Ni alloy plated film having an Ni content ranging from 8 to 20% by weight without using any silver ions in a substantial amount and the resulting black film is excellent in corrosion resistance.

6 Claims, No Drawings

BLACK CHROMATE-TREATMENT SOLUTION FOR ZN-NI ALLOY PLATED FILM

BACKGROUND OF THE INVENTION

The present invention relates to a chromate-treatment solution which is used for forming a corrosion-resistant chromate conversion film having black appearance on a Zn-Ni alloy plated film and a method for forming a black chromate conversion film.

There have been developed Zn-Ni alloy-plating techniques for improving the zinc plated film in its corrosion resistance and there have correspondingly been proposed various black chromate-treatment solutions. For instance, Japanese Un-Examined Patent Publication (hereinafter referred to as "J. P. KOKAI") Nos. Hei 7-166367 and Hei 4-56782 and Japanese Examined Patent Publication (hereinafter referred to as "J. P. KOKOKU") No. Hei 7-30456 disclose black chromate-treatment solutions in which carboxylic acids are added to silver-containing chromate-treatment solutions for Zn plated films.

However, these treating solutions require the use of silver for imparting black appearance to plated films and this accordingly leads to an increase in its cost. Moreover, they suffer from such a problem that these treating solutions easily cause discoloration under high temperature and humidity conditions or under irradiation with light rays (in particular, ultraviolet rays) because of the presence of silver. Moreover, J. P. KOKAI No. Hei 1-168875 discloses a black chromate-treatment solution for Zn-Ni alloy plated films having a rate of Ni codeposition ranging from 0.1 to 6% by weight, which is free of silver. However, if this black chromate-treatment solution is used for coating a Zn-Ni alloy plated film having a rate of Ni codeposition ranging from 8 to 20% by weight, any black chromate conversion film is not formed thereon at all and accordingly, any Zn-Ni alloy plated film excellent in appearance and corrosion resistance cannot be obtained.

On the other hand, U.S. Pat. No. 5,415,702 discloses a method for forming a black chromate film in which an additive such as trivalent chromium, phosphorous acid or hypophosphorous acid is incorporated into the chromate-treatment solution for a Zn-Ni alloy plated film having a rate of Ni codeposition ranging from 8 to 20% by weight. However, the resulting chromate film is a thin smut-like one which is insufficient in corrosion resistance and requires an additional treatment such as application of an overcoat. In addition, J. P. KOKAI Nos. Hei 4-232279 and Hei 4-232280 also disclose methods for blackening Zn-Ni alloy plated films having an Ni content ranging from 10 to 15% by weight through the use of a chromate solution containing hexavalent chromium, nitric acid residues and/or sulfuric acid residues. However, these methods never permit the formation of any chromate film excellent in corrosion resistance. More specifically, these methods surely permit the formation of a plated film exhibiting blackish appearance, but the film is insufficiently tinged with black and is thin and non-uniform. For this reason, the films formed according to these methods likewise require a further treatment for improving the corrosion resistance such as application of an overcoat.

SUMMARY OF THE INVENTION

It is an object of the present invention to provide a black chromate-treatment solution which can form, on a Zn-Ni alloy plated film, a black chromate conversion film excellent in corrosion resistance without using any silver component while maintaining excellent black appearance thereof.

Another object of the present invention is to provide a method for forming a black chromate conversion film using the foregoing black chromate-treatment solution.

These and other objects of the present invention will be apparent from the following description and examples.

The inventors of this invention have conducted various studies to eliminate the foregoing drawbacks associated with the conventional black chromate conversion film-forming techniques, have found out that the foregoing objects can effectively be accomplished by incorporation of nitric acid residues and a specific metal or a salt thereof into a black chromate-treatment solution and thus have completed the present invention.

According to an aspect of the present invention, there is provided a black chromate-treatment solution for Zn-Ni alloy plated films, which comprises 1 to 100 g/l of hexavalent chromium, 1 to 100 g/l of hydrochloric acid residues and/or sulfuric acid residues, 1 to 100 g/l of nitric acid residues and 1 to 100 g/l of at least one metal selected from the group consisting of iron, nickel, cobalt and copper.

According to another aspect of the present invention, there is provided a method for forming a black chromate film on a Zn-Ni alloy plated film which comprises the step of bringing a Zn-Ni alloy plated film having an Ni content ranging from 8 to 20% by weight into contact with the foregoing chromate-treatment solution.

DESCRIPTION OF THE PREFERRED EMBODIMENTS

The present invention will hereinafter be described in detail with reference to preferred embodiments.

Examples of compounds serving as sources of the hexavalent chromium component usable in the present invention are chromic acid or salts thereof, bichromic acid or salts thereof and mixture thereof. An amount of hexavalent chromium in the black chromate-treatment solution ranges from 1 to 100 g/l and preferably 10 to 50 g/l.

Examples of compounds usable herein as sources of hydrochloric acid residues or sulfuric acid residues are hydrochloric acid, sulfuric acid or salts thereof (such as sodium, potassium and ammonium salts) or mixture thereof. An amount of hydrochloric acid and/or sulfuric acid residues present in the hexavalent chromium-containing black chromate-treatment solution ranges from 1 to 100 g/l and preferably 10 to 100 g/l.

Examples of compounds used in the invention as sources of nitric acid residues include nitric acid or salts thereof (such as sodium nitrate and potassium nitrate) or mixture thereof. In the chromate-treatment solution of the invention, an amount of nitric acid residues ranges from 1 to 100 g/l and preferably 5 to 50 g/l.

As compounds usable herein as sources of iron, nickel, cobalt and copper, there may be listed, for instance, these elemental metals or salts thereof. Examples of salts thereof are iron(II) or iron(III) chloride, iron(II) or iron(III) sulfate, iron(II) or iron(III) nitrate, nickel chloride, nickel sulfate, nickel nitrate, cobalt chloride, cobalt sulfate, cobalt nitrate, copper(I) or copper(II) chloride, copper sulfate and copper nitrate. An amount thereof in the black chromate-treatment solution ranges from 1 to 100 g/l and preferably 5 to 50 g/l.

The black chromate-treatment solution of the invention essentially comprises the foregoing components and the balance of water. The pH thereof preferably ranges from 0.5 to 2.5 and more preferably 0.5 to 1.5.

The black chromate-treatment solution preferably comprises at least one member selected from the group consisting of carboxylic acids, sulfonated derivatives of carboxylic acids and salts thereof, in addition to the foregoing essential components. Examples of carboxylic acids or sulfonated derivatives thereof include carboxylic acids having 2 to 4 carbon atoms such as formic acid, acetic acid, succinic acid and diglycollic acid or sulfonated derivatives of aromatic carboxylic acids having 7 to 15 carbon atoms such as sulfobenzoic acid, sulfophthalic acid, sulfoterephthalic acid and sulfonated derivatives of naphthalic acid. Moreover, the sulfonated derivatives of carboxylic acids may also include those of aliphatic dicarboxylic acids such as sulfonated derivatives of succinic acid and adipic acid. The foregoing salts may be any ones insofar as they are soluble in the black chromate-treatment solution. Specific examples of such salts are sodium and ammonium salts. The black chromate-treatment solution preferably comprises the foregoing at least one member selected from the group consisting of carboxylic acids, sulfonated derivatives of carboxylic acids and salts thereof, in an amount ranging from 0.5 to 100 g/l and more preferably 5 to 50 g/l.

The black chromate-treatment solution of the invention is effective for forming a black chromate film on a Zn-Ni alloy plated film having any composition, in particular, the treating solution permits easy formation of a black chromate conversion film on a Zn-Ni alloy plated film having a rate of Ni codeposition of not more than 20% by weight, preferably 8 to 20% by weight and more preferably 10 to 15% by weight. More specifically, it has conventionally been difficult to form a black chromate conversion film on a Zn-Ni alloy plated film having a rate of Ni codeposition ranging from 8 to 20% by weight, but the treating solution of the present invention permits the formation of a black chromate conversion film with ease and can easily impart black chromate appearance to the resulting film.

The method for black chromate-treatment comprises the step of bringing a Zn-Ni alloy plated film as a subject to be treated (substrate) into contact with the black chromate-treatment solution of the present invention. For instance, it is desirable that a substrate provided thereon with a Zn-Ni alloy plated film is immersed in the black chromate-treatment solution maintained at a temperature ranging from 15° to 50° for 30 to 300 seconds, preferably 30 to 180 seconds while stirring by mechanical agitation or air-blowing to thus form a black chromate film thereon.

More specifically, in the invention, it is desirable to form a Zn-Ni alloy plated film (preferably having a rate of Ni codeposition ranging from 8 to 20% by weight and a thickness of the plated film of not less than 2 μm, preferably 5 to 20 μm) on a substrate according to the usual method before forming a black chromate film by the foregoing method.

As has been discussed above in detail, the present invention permits the formation of a uniform black chromate conversion film on a Zn-Ni alloy plated film without using any silver ions in a substantial amount and the resulting black film is excellent in corrosion resistance, while maintaining excellent black appearance.

Thus, the products to which black chromate conversion films are applied using the black chromate-treatment solution according to the present invention may widely be used as parts for use in motor cars, household appliance (or appliance) and construction materials.

The present invention will hereinafter be described in more detail with reference to the following non-limitative working Examples and Comparative Examples.

EXAMPLE 1

A steel plate on which a Zn-Ni alloy film (having a rate of Ni codeposition of 15% by weight) had been formed, through plating, in a thickness of 8 μm was immersed in a chromate-treatment solution having the following composition at 35° C. for 90 seconds. As a result, a black chromate film was formed, which exhibited high quality and was uniform. The pH of the treating solution was adjusted using an NaOH aqueous solution.

| | |
|---|---|
| $CrO_3$ | 12 g/l |
| 35% HCl | 12 g/l |
| $FeCl_3.6H_2O$ | 30 g/l |
| 62% $HNO_3$ | 20 g/l |
| water | the balance |
| pH | 0.8 |

EXAMPLE 2

A steel plate on which a Zn-Ni alloy film (having a rate of Ni codeposition of 10% by weight) had been formed, through plating, in a thickness of 5 μm was immersed in a chromate-treatment solution having the following composition at 35° for 90 seconds. As a result, a black chromate film was formed, which had high quality and was uniform. The pH of the treating solution was adjusted using an NaOH aqueous solution.

| | |
|---|---|
| $CrO_3$ | 12 g/l |
| NaCl | 10 g/l |
| $NiCl_2.6H_2O$ | 20 g/l |
| 62% $HNO_3$ | 30 g/l |
| water | the balance |
| pH | 1.0 |

EXAMPLE 3

A steel plate on which a Zn-Ni alloy film (having a rate of Ni codeposition of 18% by weight) had been formed, through plating, in a thickness of 10μm was immersed in a chromate-treatment solution having the following composition at 35° C. for 90 seconds. As a result, a black chromate film was formed, which had high quality and was uniform. The pH of the treating solution was adjusted using an NaOH aqueous solution.

| | |
|---|---|
| $CrO_3$ | 12 g/l |
| 35% HCl | 8 g/l |
| $CoCl_2.6H_2O$ | 25 g/l |
| 62% $HNO_3$ | 15 g/l |
| water | the balance |
| pH | 1.3 |

EXAMPLE 4

A steel plate on which a Zn-Ni alloy film (having a rate of Ni codeposition of 15% by weight) had been formed, through plating, in a thickness of 8 μm was immersed in a chromate-treatment solution having the following composition at 35° C. for 90 seconds. As a result, a black chromate film was formed, which exhibited high quality and was uniform. The pH of the treating solution was adjusted using an NaOH aqueous solution.

| | |
|---|---|
| $CrO_3$ | 12 g/l |
| NaCl | 7 g/l |
| CuCl | 11 g/l |
| 62% $HNO_3$ | 20 g/l |
| water | the balance |
| pH | 1.5 |

EXAMPLE 5

A steel plate on which a Zn-Ni alloy film (having a rate of Ni codeposition of 13% by weight) had been formed, through plating, in a thickness of 10 μm was immersed in a chromate-treatment solution having the following composition at 35° C. for 90 seconds. As a result, a black chromate film was formed, which exhibited high quality. The pH of the treating solution was adjusted using an NaOH aqueous solution.

| | |
|---|---|
| $CrO_3$ | 12 g/l |
| NaCl | 7 g/l |
| $FeCl_3.6H_2O$ | 20 g/l |
| 62% $HNO_3$ | 25 g/l |
| 80% acetic acid | 25 g/l |
| water | the balance |
| pH | 1.2 |

EXAMPLE 6

A steel plate on which a Zn-Ni alloy film (having a rate of Ni codeposition of 15% by weight) had been formed, through plating, in a thickness of 8 μm was immersed in a chromate-treatment solution having the following composition at 35° C. for 90 seconds. As a result, a black chromate film was formed, which exhibited high quality. The pH of the treating solution was adjusted using an NaOH aqueous solution.

| | |
|---|---|
| $CrO_3$ | 12 g/l |
| NaCl | 7 g/l |
| $FeCl_3.6H_2O$ | 20 g/l |
| 62% $HNO_3$ | 25 g/l |
| sulfosuccinic acid | 10 g/l |
| water | the balance |
| pH | 1.4 |

Comparative Example 1

A steel plate on which a Zn plated film had been formed in a thickness of 8 μm was subjected to a black chromate-treatment at 25° C. for 60 seconds using a black chromate-treatment solution for Zn plated films having the following composition:

| | |
|---|---|
| $CrO_3$ | 20 g/l |
| $Na_2SO_4$ | 10 g/l |
| 85% $H_3PO_4$ | 5 g/l |
| $AgNO_3$ | 0.5 g/l |
| water | the balance |
| pH | 0.8 |

Comparative Example 2

A steel plate on which a Zn-Ni alloy plated film (having a rate of Ni codeposition of 6% by weight) had been formed in a thickness of 8 μm was subjected to a black chromate-treatment at 25° C. for 90 seconds using a black chromate-treatment solution for Zn-Ni alloy plated films having the following composition:

| | |
|---|---|
| $CrO_3$ | 10 g/l |
| $Na_2SO_4$ | 12 g/l |
| succinic acid | 10 g/l |
| $AgNO_3$ | 0.5 g/l |
| water | the balance |
| pH | 1.4 |

Comparative Example 3

A steel plate on which a Zn-Ni alloy plated film (having a rate of Ni codeposition of 13% by weight) had been formed in a thickness of 8 μm was subjected to a black chromate-treatment at 30° C. for 60 seconds according to the procedures used in Example 4 disclosed in J. P. KOKAI No. Hei 4-232279. In this respect, the composition of the black chromate-treatment solution used herein was as follows:

| | |
|---|---|
| $CrO_3$ | 4 g/l |
| 62% $HNO_3$ | 10 g/l |
| 98% $H_2SO_4$ | 5 g/l |
| water | the balance |
| pH | 1.0 |

Comparative Example 4

A steel plate on which a Zn-Ni alloy plated film (having a rate of Ni codeposition of 13% by weight) had been formed in a thickness of 8 μm was subjected to a black chromate-treatment at 21° C. for 30 seconds according to the procedures used in Example 1 disclosed in U.S. Pat. No. 5,415,702.

The articles prepared in Examples and Comparative Examples each provided with the corresponding black chromate film were inspected for the corrosion resistance and resistance to discoloration under high temperature and humidity conditions according to the following methods:

(1) Corrosion Resistance

The corrosion resistance of these articles were determined by the salt spray test as specified in JIS-Z-2371. More specifically, the white rust-forming time (W.R.T.) was defined to be the time required for forming white rust on 5% of the total surface area of the article, while the red rust-forming time (R.R.T.) was defined to be the time required for forming a single spot of red rust thereon.

(2) Evaluation of Color Tone Change Under High Temperature and Humidity Conditions:

Each article was allowed to stand for 72 hours at 35° C./95% relative humidity and then the color tone change was evaluated through visual observation.

(3) Evaluation of Color Tone Change Under Irradiation With UV Rays

Each article was irradiated with UV rays emitted from a UV lamp available from Ultraviolet Co., Ltd. for one hour and then the color tone change was visually evaluated on the basis of the following criteria:

No Change: ○

Changed: X

The results thus obtained are summarized in the following Tables 1 and 2.

TABLE 1

| Ex. No. | Kind of Plating | Rate of Ni Codep. (wt %) | Thickness of Plated Film (μm) | Color Tone | Salt Spray Test W.R.T.[1] (hr) | Salt Spray Test R.R.T.[2] (hr) |
|---|---|---|---|---|---|---|
| 1 | Zn–Ni | 15 | 8 | uniform black | ≧500 | ≧2000 |
| 2 | Zn–Ni | 10 | 5 | brownish uniform black | ≧500 | ≧2000 |
| 3 | Zn–Ni | 18 | 10 | brownish uniform black | ≧500 | ≧2000 |
| 4 | Zn–Ni | 15 | 8 | greenish uniform black | ≧500 | ≧2000 |
| 5 | Zn–Ni | 13 | 10 | uniform black | ≧500 | ≧2000 |
| 6 | Zn–Ni | 15 | 8 | uniform black | ≧500 | ≧2000 |
| 1* | Zn | 0 | 8 | uniform black | 144 | 600 |
| 2* | Zn–Ni | 6 | 8 | uniform black | ≧500 | ≧2000 |
| 3* | Zn–Ni | 13 | 8 | thin gray film | ≦24 | 800 |
| 4* | Zn–Ni | 13 | 8 | thin smut-like film | ≦24 | 800 |

*: Comparative Example
[1]White Rust-Forming Time
[2]Red Rust-Forming Time

TABLE 2

| Ex. No. | Kind of Plating | Rate of Ni Codep. (wt %) | Film Thickness (μm) | Color Tone Change Evaluation: Under High Temp. & Humidity | Color Tone Change Evaluation: Under UV Rays Irradiation |
|---|---|---|---|---|---|
| 1 | Zn-Ni | 15 | 8 | ○ | ○ |
| 2 | Zn-Ni | 10 | 5 | ○ | ○ |
| 1 * | Zn | 0 | 8 | x | x |
| 2 * | Zn-Ni | 6 | 8 | x | x |

* Comparative Example

What is claimed is:

1. A method for forming a black chromate film on a Zn-Ni alloy plated film, comprising bringing a Zn-Ni alloy plated film having a Ni content ranging from 8 to 20% by weight into contact with a black chromate-treatment solution which comprises 1 to 100 g/l of hexavalent chromium, 1 to 100 g/l of hydrochloric acid residues, 1 to 100 g/l of nitric acid residues 1 to 100 g/l of at least one metal selected from the group consisting of iron, nickel, cobalt and copper, and a balance of water, and which solution is substantially free of silver ions.

2. The method of claim 1, wherein the solution further comprises of at least one member selected from the group consisting of carboxylic acids, sulfonated derivatives of carboxylic acids and salts thereof, in an amount ranging from 0.5 to 100 g/l.

3. The method of claim 1, wherein 5 to 50 g/l of nitric acid residues is used.

4. The method of claim 1, wherein the plated film is brought into contact with the black chromate treatment solution at a temperature ranging from 15° to 50° C. for 30 to 300 seconds.

5. A method for forming a black chromate film on a Zn-Ni alloy plated film, comprising bringing a Zn-Ni alloy plated film having a Ni content ranging from 8 to 20% by weight into contact with a black chromate treatment solution at a temperature ranging from 15° to 50° C. for 30 to 300 seconds, the black chromate-treatment comprising 10 to 50 g/l of hexavalent chromium, 10 to 100 g/l of hydrochloric acid residues, 5 to 50 g/l of nitric acid residues, 5 to 50 g/l of at least one metal selected from the group consisting of iron, nickel, cobalt and copper, and a balance of water, and having a pH ranging from 0.5 to 2.5, and which solution is substantially free of silver ions.

6. The method of claim 5, wherein the solution further comprises at least one member selected from the group consisting of carboxylic acids, sulfonated derivatives of carboxylic acids and salts thereof, in an amount ranging from 0.5 to 100 g/l.

* * * * *